United States Patent [19]

Viscardi

[11] Patent Number: 4,537,228

[45] Date of Patent: Aug. 27, 1985

[54] WEFT PRESENTING DEVICE FOR WEAVING LOOMS

[75] Inventor: Ettore Viscardi, Nembro, Italy

[73] Assignee: Somet Societa' Meccanica Tessile S.p.A., Bergamo, Italy

[21] Appl. No.: 511,260

[22] Filed: Jul. 6, 1983

[30] Foreign Application Priority Data

Jul. 19, 1982 [IT] Italy ..... 22441/82[U]

[51] Int. Cl.[3] ..... D03D 47/38

[52] U.S. Cl. ..... 139/453

[58] Field of Search ..... 139/450, 453

[56] References Cited

U.S. PATENT DOCUMENTS 4,076,054 2/1978 Merisio ..... 139/453

4,326,566 4/1982 Lampaert ..... 139/453

4,438,791 3/1984 Oesterle et al. ..... 139/453

*Primary Examiner*—Henry S. Jaudon

*Assistant Examiner*—S. Shongut

*Attorney, Agent, or Firm*—Stevens, Davis, Miller & Mosher

[57] ABSTRACT

In a weft presenting device for weaving looms with continuous weft feed, the levers controlling the presenting needles are subjected, on one side, to the constant action of return springs towards the inoperative position of said needles and, on the other side, to the cyclic action of cam-controlled control rods towards the operative position of said needles, the levers being kept in this position by electromagnets energized by the selection devices forming the pattern of the fabric being woven, up to operating said needles.

3 Claims, 2 Drawing Figures

WEFT PRESENTING DEVICE FOR WEAVING LOOMS

BACKGROUND OF THE INVENTION

The present invention relates to weft presenting devices for weaving looms, namely to those devices applied at one end of the looms with continuous weft feed, to feed the same with the weft threads which are then carried through the shed by the loom gripping and transport members (usually grippers).

As known, the conventional presenting devices normally comprise a plurality of presenting needles, through an end hole of which is let the weft thread to be fed and which are positioned parallel and oscillating partially inside a containment case, from which they project one at a time to present their own thread to the gripping and transport member, each with a movement selected by an electromagnet with movable core, which is in turn energized by the selection devices forming the pattern of the fabric being woven on the loom.

With the increase in the speed of looms, some difficulty has been found in obtaining from the conventional presenting devices the desired working reliability, indispensible for a correct and appropriate weaving, owing to the inertias and consequent imprecisions in the selection of the presenting needles operated by the electromagnets.

It has therefore been thought to modify the way of controlling the needles in the presenting devices, by combining the mechanical operation of such needles with an electromagnetic memory of their mechanical selection. The electromagnetic selection movement is thereby eliminated, thus considerably improving the performances of the presenting devices, wherein the needles selection speed is independent from the response times of the electromagnets.

SUMMARY OF THE INVENTION

Such an improvement is the object of the present invention, which concerns more specifically a presenting device for weaving looms with continuous weft feed, characterized in that, the levers controlling the presenting needles are subjected, on one side, to the constant action of return springs towards the inoperative position of the presenting needles and, on the other side, to the cyclic action of cam-controlled control rods towards the operative position of the presenting needles, the levers being kept in this position by electromagnets energized by the selection devices forming the pattern of the fabric being woven, up to operating said needles.

BRIEF DESCRIPTION OF THE DRAWINGS

An embodiment of the device is illustrated in the accompanying drawing, in which.

DESCRIPTION OF THE PREFERRED EMBODIMENT

Figure 1:
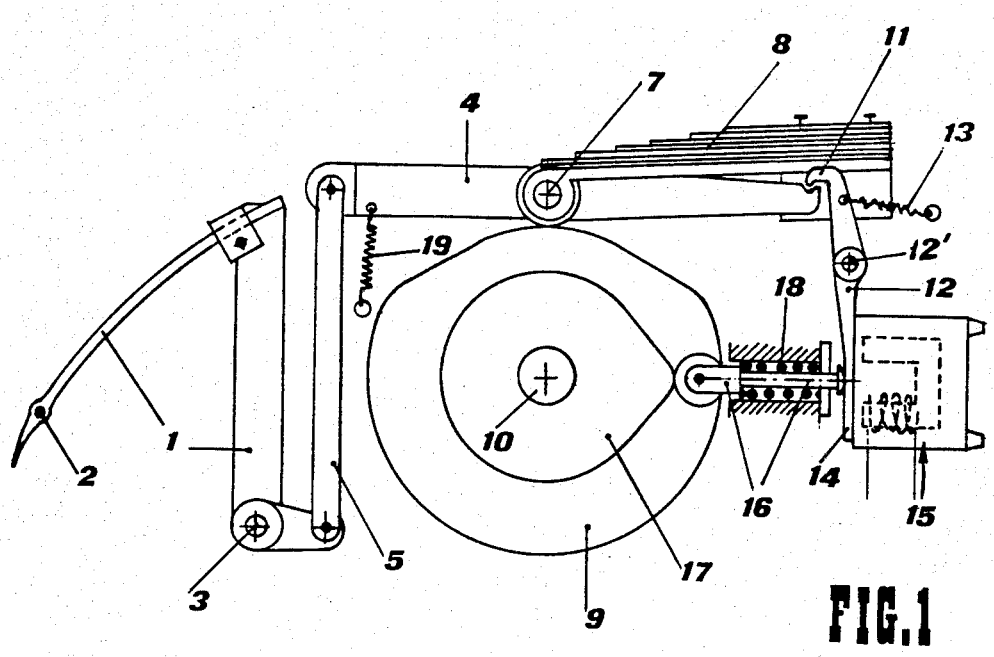
FIG. 1 is a diagrammatic lateral view of the essential elements of the presenting device according to the invention, without its containment case.
Figure 2:
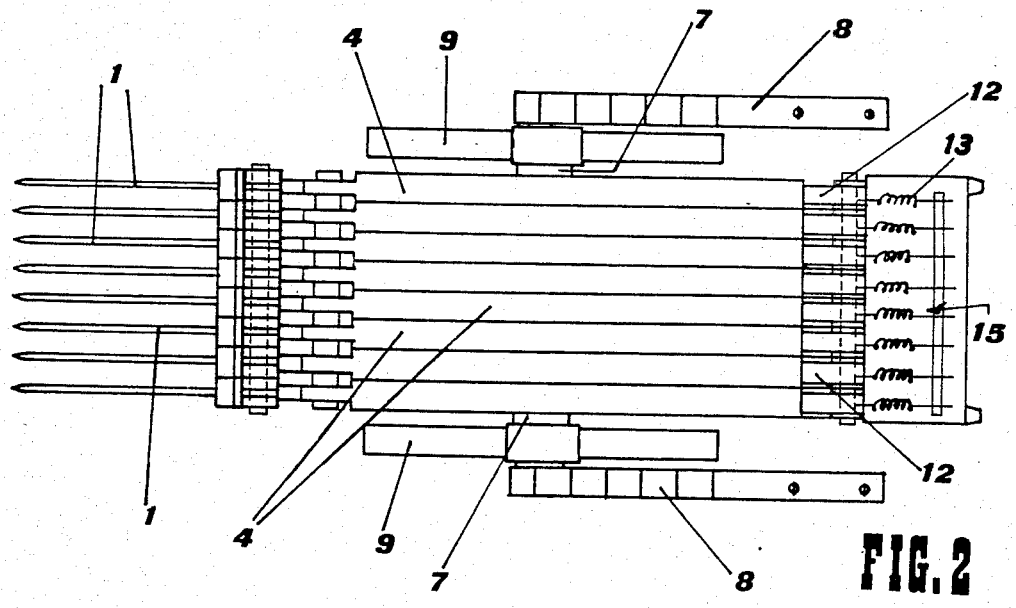
FIG. 2 is a diagrammatic top view of the same elements of the presenting device of FIG. 1.

With reference to the drawing, the presenting device according to the invention comprises a plurality of presenting needles 1, through the end holes 2 of which are let the weft threads (not shown) to be presented to the weft gripping and transport members of the loom on which the presenting device is mounted. The needles 1 are mounted to oscillate about the axis 3 of the presenting device, under the control of rocking levers 4 and of connecting rods 5. The rocking levers 4 are in turn oscillating about a pin 7, which is pressed by two lateral leaf springs 8 in contact with two lateral cams 9 rotating about a pin 10. The free end of the rocking levers 4 can be engaged with or disengaged from the end hook 11 of control levers 12, pivoted in 12' at an intermediate point thereof, which levers are subjected to the action of return springs 13 and are adopted to form, with their other end, the cores 14 of electromagnets 15.

According to the invention, control rods 16 are pressed by cams 17, jointly rotating with the cams 9 on the same pin 10, against the core 14 of the control levers 12, overcoming the action of springs 18 which return them in a position far from said levers 12. Spring 18 maintains rod 16 in contact with cam 17. There is a cam 17 and rod 16 for each rocking lever 4 and each control lever 12.

A spring 19 tends to keep lowered the end of the rocking levers 4 bound to the connecting rods 5 connected to the presenting needles 1.

In operation, the cam 9 lift—in a specific phase—the rocking levers 4 by means of pin 7. For each rocking lever 4, if the hook 11 or the corresponding lever 12 engages the free end of the rocking lever, the other end thereof is lifted against the action of the spring 19 together with the connecting rod 5, and the corresponding needle 1 of the presenting device is caused to project from the case of the device to present its weft thread. If, on the contary, the hook 11 of the lever 12 releases the end of the rocker lever 4, it is actually this end which will be lifted, thanks to the action of the spring 19 onto the opposite end thereof, and the corresponding needle 1 of the presenting device will remain inoperative.

According to the invention, the control levers 12 are driven in the position (shown in the drawing) of engagement of the respective rocking levers 4, by the corresponding control rods 16, with a certain advance on the operation of the rocking levers, thanks to the offsetting of the cams 9 and 17 (also resulting from the drawing). Each lever 12 is held in this position by the corresponding electromagnet 15—of which it will form the core—only when said electromagnet has been energized by the selection device forming the pattern of the fabric being woven.

If the electromagnet 15 is energized, the lever 12 is checked and the hook 11 thereof keeps in engagement with its rocking lever 4, so that the corresponding presenting needle 1 is caused to project in order to feed the weft to the loom. Whereas, if the electromagnet 15 is de-energized, the lever 12 is not held in the position shown in the drawing, but it is caused to oscillate clockwise by the spring 13; the hook 11 thus releases the corresponding end of the rocking lever 4, which is lifted when the cam 9 operates a pressure in correspondence of the pin 7 of the rocking levers: the presenting needle 1 thus receives no control and remains in an inoperative or retracted position.

It is evident that through the mechanical control by electromagnetically memorized selection, as illustrated, the presenting device according to the invention can be operated with far more reliability than the conventional presenting devices, and with extreme precision even at very high speeds. In fact, the levers 12 are no longer controlled—as in the conventional presenting devices—by the movable core of the magnets, and the response times to the selection are hence independent from the shifting times of said cores (which, in the electromagnets 15 are not movable) and merely depend on the movements, having no inertias, of the cams 17. The invention therefore supplies a very valid contribution towards improving the proper working of weaving looms with continuous weft feed, at the high speeds increasingly demanded by modern weaving.

I claim:

1. Weft presenting device for a weaving loom with continuous weft feed, comprising a presenting needle oscillatable between an inoperative and operative position, a pivotal rocking lever, a connecting rod pivotally attaching said needle and one end of said rocking lever, a spring on said end of said rocking lever to bias said rocking lever toward an inoperative position corresponding to the inoperative position of said needle, a pivotal control lever having a hook on one end to engage the other end of said rocking lever, a first rotatable cam having a cam surface, a control rod having one end in contact with the surface of said first cam, the other end of said control rod contactible with the other end of said pivotal control lever to push said control lever into an engageable position with said rocking lever under the action of said first cam, a spring connected to said control lever to bias it in an unengageable direction and electromagnetic means to be energized to hold said control lever in an engageable position with the other end of said rocking lever.

2. The weft presenting device of claim 1 wherein said control lever is oscillated about an intermediate point and the other end of said control lever forms the core of said electromagnetic means.

3. The weft presenting device of claim 1 including a second rotatable first and second cam for operating said rocking lever, said cams being mounted on the same axis.

* * * * *